United States Patent [19]

Eggert, Jr.

[11] 4,338,865

[45] Jul. 13, 1982

[54] RAILWAY TRUCK ADAPTABLE TO RECEIVE A COMMON PRIMARY SUSPENSION AND VARIABLE JOURNAL BEARINGS

[75] Inventor: Walter S. Eggert, Jr., Huntington Valley, Pa.

[73] Assignee: The Budd Company, Troy, Mich.

[21] Appl. No.: 166,360

[22] Filed: Jul. 7, 1980

[51] Int. Cl.[3] ..... B61F 5/26; B61F 5/06

[52] U.S. Cl. ..... 105/202; 105/206 A; 105/224.1

[58] Field of Search ..... 105/202, 224.1, 218 R, 105/218 A, 220, 221, 206

[56] References Cited

U.S. PATENT DOCUMENTS

| | | | |
|---|---|---|---|
| 860,955 | 7/1907 | Wright et al. | 105/202 |
| 2,538,307 | 1/1951 | Gaver | 105/202 |
| 2,620,744 | 12/1952 | Gray et al. | 105/202 |
| 3,946,677 | 3/1976 | Henricot | 105/224.1 |
| 3,952,669 | 4/1976 | Mavzin et al. | 105/224.1 |

*Primary Examiner*—Richard A. Bertsch
*Attorney, Agent, or Firm*—A. L. Trueax, Jr.

[57] ABSTRACT

A basic truck for a railway car includes a pair of side frames connected by suitable transverse disposed members. Standard structural members for holding different types of suspension and journal bearings of the car are provided and are secured to the end of the side frames at predetermined locations dependent upon the types of suspension and journal bearings used. Gusset members designed in accordance with the operating car requirements are connected to provide the principal structural connections between the mountings and the side frames.

5 Claims, 6 Drawing Figures

10
12
14
16
18
20
22
23
24
26
28
30
32
34
36
37
38

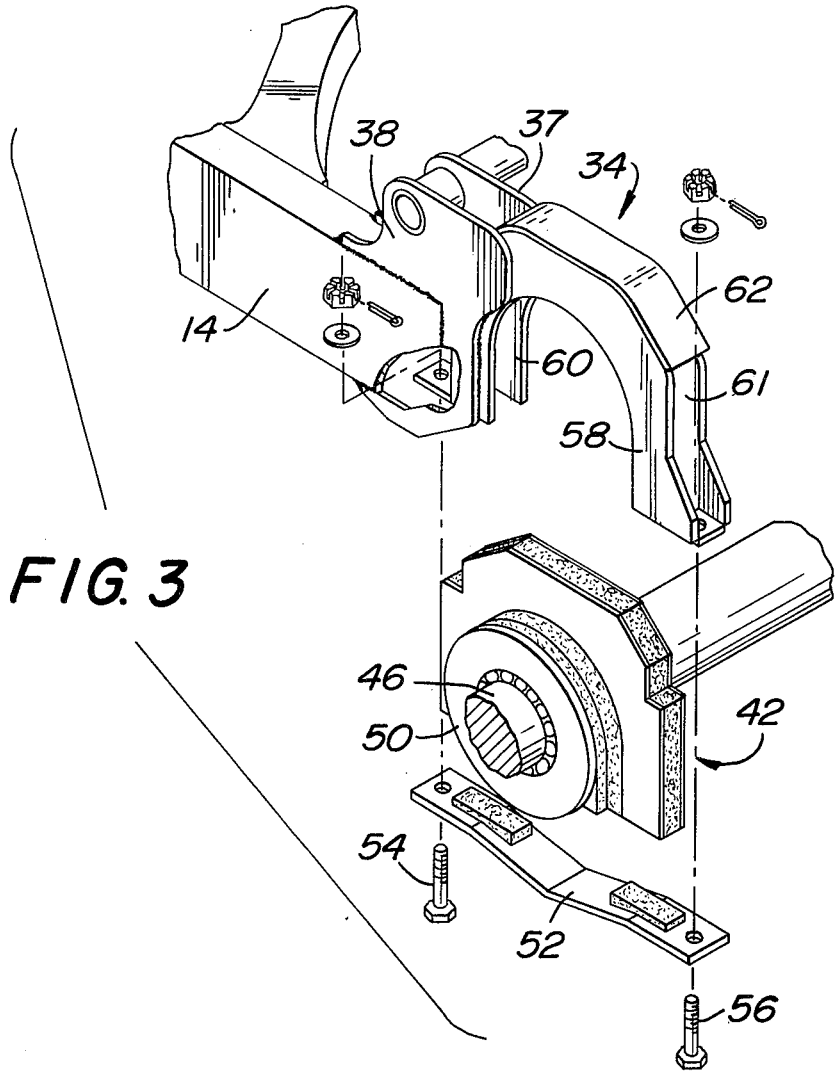
FIG. 3
FIG. 4
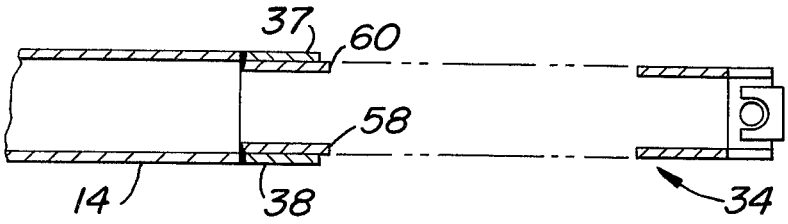

RAILWAY TRUCK ADAPTABLE TO RECEIVE A COMMON PRIMARY SUSPENSION AND VARIABLE JOURNAL BEARINGS

BACKGROUND OF THE INVENTION

Railway trucks utilizing side frames connected by spider shaped members extending inwardly therefrom or other transversely disposed connecting members are used extensively to support car bodies. Such trucks are adapted to receive such structures as bolsters, air suspension springs and the like. Also, mountings to receive the wheel axle units are provided with the mountings designed to receive primary suspension springs and journal bearings therein.

Generally, trucks used heretofore have been designed in accordance with the particular requirements of the car body. For example, particular car bodies may be designed to carry a wide range of different loads ranging from very heavy loads to relatively light loads. In many cases heretofore, the trucks used to support the car bodies were either custom designed or, if such trucks were close to the requirement, had to be substantially modified.

The modifications required in the trucks have generally related to the primary suspension springs requirements. Different loads require different size springs at different locations on the truck frame. Also, often the wheel sizes and journal bearings make it necessary to relocate the journal bearings with respect to the truck frame.

OBJECTS OF THE INVENTION

It is an object of this invention to provide a railway truck adaptable to accommodate car bodies for different loads.

It is still a further object of this invention to provide a railway truck adaptable to receive a common primary suspension and variable journal bearings at different locations with respect to the truck frame.

BRIEF SUMMARY OF THE INVENTION

In accordance with the present invention, a basic truck frame includes a pair of side frames with interconnecting transverse members. Mountings for primary suspension and journal bearings of a standard design are provided. To the primary mounting assemblies, the mountings are then secured to the side frame ends at selected locations dependent on the car requirements and manufacturing tolerance variations thus providing compensation of their variables for the final assembly and providing a structural connection between the frame ends and the mountings. Gusset members, designed in accordance with the operating car requirements, provide the principal structural connection of mountings to the side frames thus providing structural redundancy for the mounting to frame connections.

Other objects and advantages of the present invention will be apparent and suggest themselves to those skilled in the art, from a reading of the following specification and claims, taken in conjunction with the accompanying drawings, in which:

BRIEF DESCRIPTION OF THE DRAWINGS

FIG. 3 is a view broken away, partly exploded, illustrating one end of a side frame with connected parts, in accordance with the present invention, showing installation up the primary spring;

FIG. 4 is a cross-sectional view taken along lines 4—4 of FIG. 2;

DETAILED DESCRIPTION OF THE PREFERRED EMBODIMENTS

Figure 1:
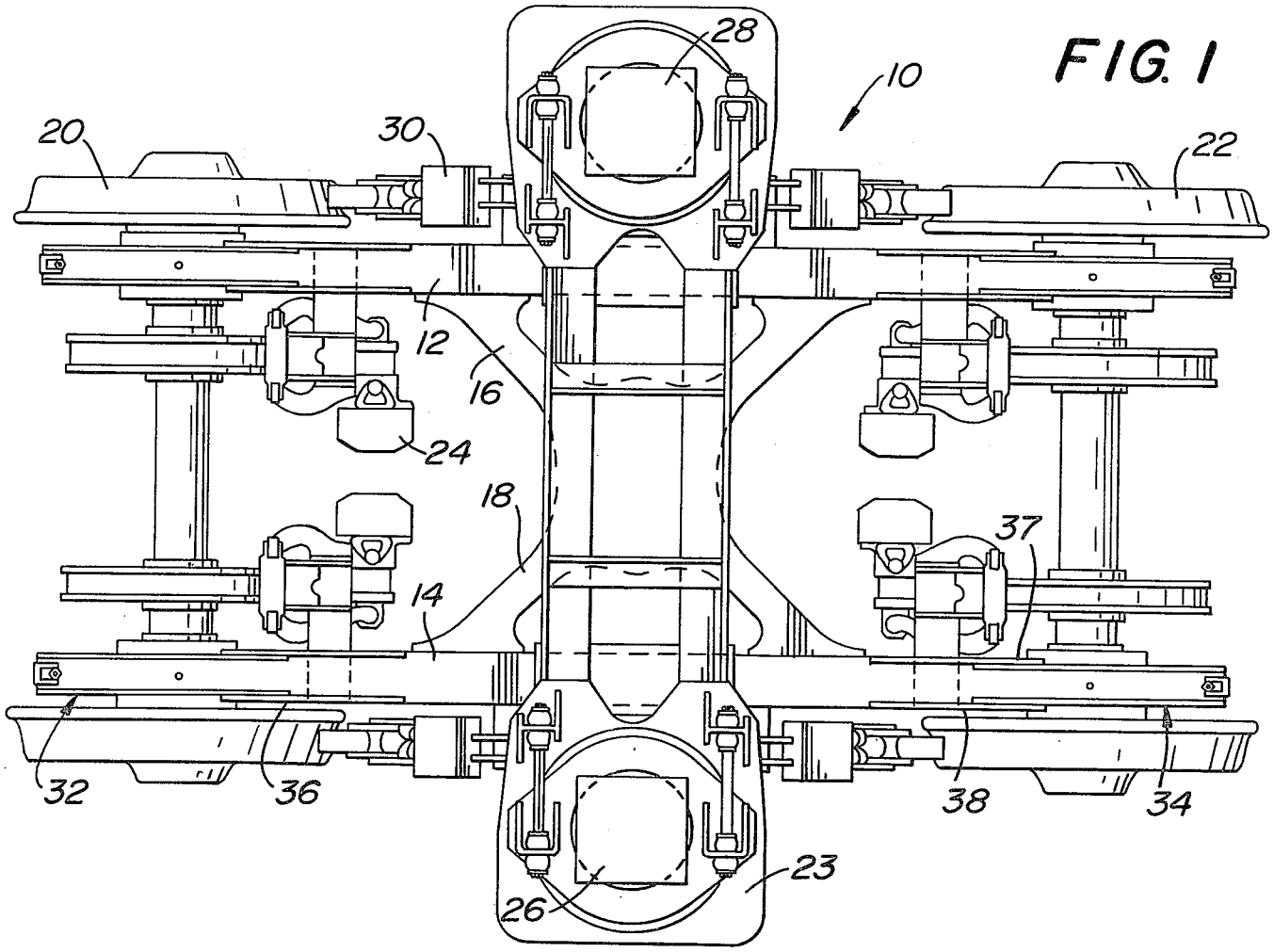
FIG. 1 is a top view of a truck and associated parts connected thereto, in accordance with the present invention.
Figure 2:
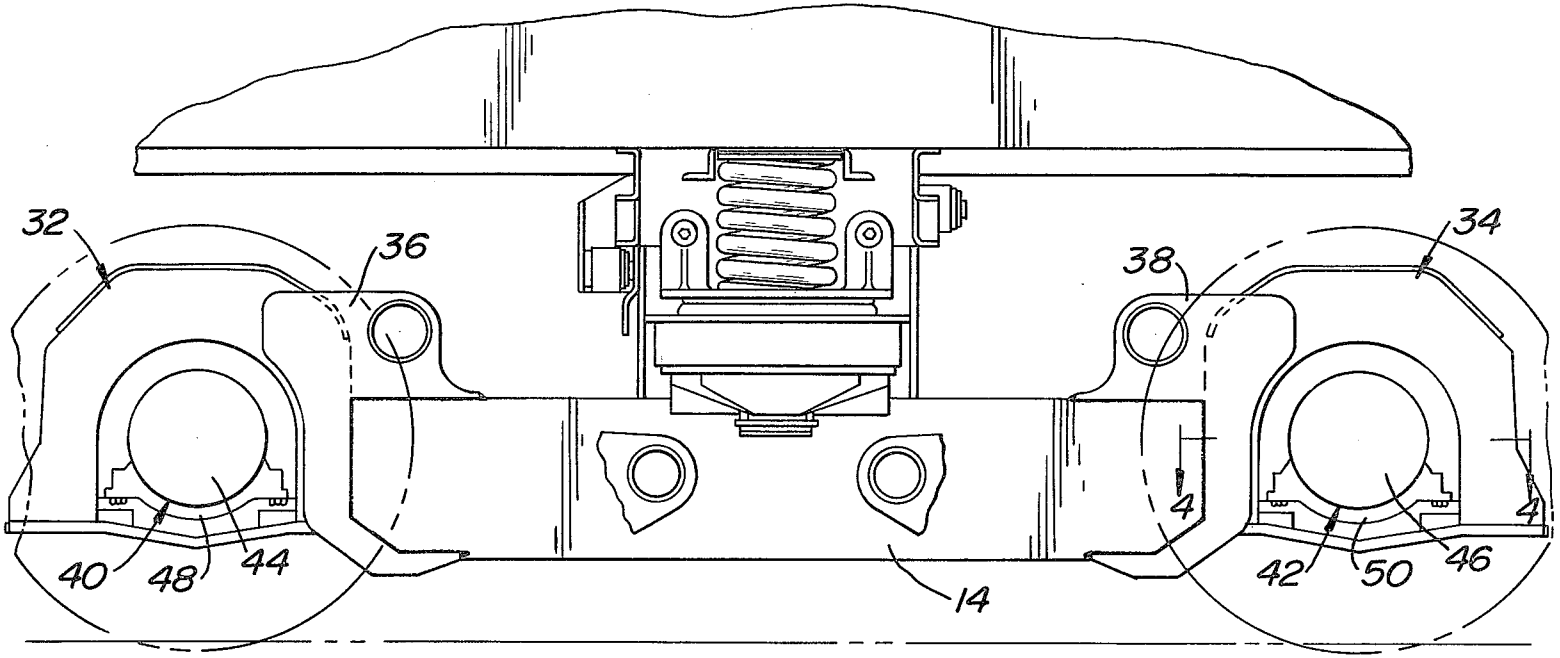
FIG. 2 is a side view of the truck of FIG. 1, with some of the parts omitted to more clearly illustrate features of the present invention.

Referring to FIGS. 1, 2, 3 of the drawings, a truck 10 includes a pair of side frames 12 and 14. The pair of V-shaped members 16 and 18 are connected to the side frames 12 and 14, respectively, to form a spider-like arrangement connected transversely between the longitudinally extending side frames.

The truck 10 is adapted to receive the conventional wheel axle units 20 and 22 in suitable bearings as will be described. Disc brake units 24 are suitably attached to the axles of the wheel axle units. Side frames 12 and 14 are adapted to receive a conventional bolster 23 for receiving suspension air springs which carry the car body. The bolster 23 includes support members 26 and 28 thereon to receive the air springs of the car. Hand brake units 30 may also be provided for breaking.

Many of the parts illustrated with the truck 10 are not directly related to the invention and are illustrated merely to show the general environment of a typical truck which is adapted to utilize the features of the present invention. Various parts illustrated will not be referred to further except as they may be related directly to the present invention. It is understood that various other parts not illustrated may be incorporated in the truck.

A feature of the present invention is directed to the side frames 12 and 14 and the transverse members for connecting the side frames. When the present invention is discussed, the term "basic truck" will be used. This term is intended to mean a truck frame including the side frames and transverse connecting members. It is intended that this basic truck be adaptable for use for different types of cars carrying varying loads ranging from very heavy to relatively light loads. The free ends of the side frames 12 and 14 are adapted to receive connecting standard mounting members with specially designed gusset elements, as will be described, which provide this adaptability.

With respect to the present invention, another feature, in addition to utilizing a basic truck for different car loads, involves the use of standard mounting members for receiving the primary suspension and journal bearings. These mountings are adapted to be the same design, regardless of the different bearing requirements or car loads. Different types of cars for different loads and possibly involving different size wheels may still use the standard mounting members of the present invention. Thus, a basic truck with standard mountings are provided. In designing a truck in accordance with the present invention for different load or bearing requirements only one item must be specially designed and that one is the connecting item or gussets between the mounting members and the side frames 12 and 14.

These gussets provide the main structural connections between the standard mountings and the basic truck or frame.

The mounting members on both side frames 12 and 14 are both similar and therefore only the connections to the side frame 14 will be described as illustrated in FIG. 2. The ends of the side frame 14 are adapted to receive mounting members 32 and 34. The mounting members 32 and 34 are connected to the ends of the side frame 14 at any desired height or at any desired depth on the ends of the side frame, dependent on car requirements. For example, different loads may require different size primary suspension systems. Also, different size wheels may be involved. Regardless of these variables required, the same basic truck with standard mountings may be used.

After the mounting members 32 and 34 have been welded or otherwise secured to the ends of the side frames at predetermined locations, the main structural connections between the mountings and the side frames must be made. Because of the possible different locations of the mounting members, the gussets or connecting elements 36 and 38 are made in accordance with the final locations and car design.

As illustrated in FIG. 4, the gussets 36 and 38 are designed to fit over the ends of the side frame 14. The particular configuration of the gussets is designed so as to be secured to both sides of the mounting members 32 and 34 at the proper heights and locations. Gussets 36 and 38 form part of a pair of similar type gussets, such as 37 and 38 as illustrated in FIGS. 3 and 4. The gusset elements 36 and 38 are welded to both the mounting members 32 and 34 and the ends of the side frame 14 to provide strong structural connections therebetween.

Figure 6:
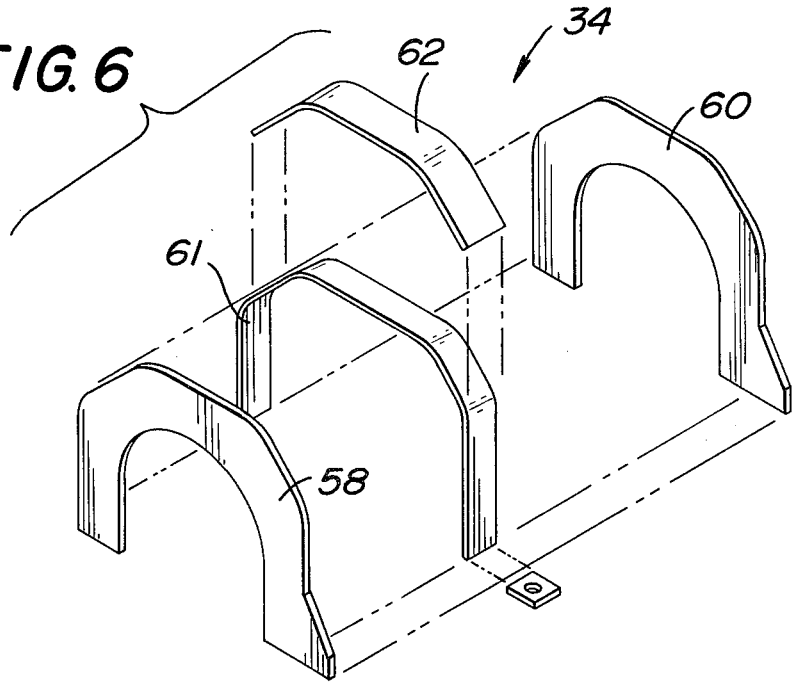
FIG. 6 is an exploded view of a mounting member in accordance with the present invention.

As illustrated in FIGS. 3 and 6, the welding connections between the side frames are provided by two separate paths to provide structural redundancy in case of failure in one of the paths. The first path is provided by the direct weld connections from the ends of the side frames to the mounting members. The second path is provided by weld connections from the truck to the gusset members and then to the mounting members.

The mounting members 32 and 34 are adapted to receive primary suspension bearings 40 and 42, respectively, therein. These bearings may be of different sizes depending upon the load requirements of the car. Consequently, when the primary suspension means 40 and 42 are relatively large, it may be necessary to locate the mounting members 32 and 34 at higher positions with respect to the axles 44 and 46 of the car. On the other hand, when relatively light loads are involved, smaller primary suspension bearings are used which may necessitate lower locations for the mounting members 32 and 34.

It may also be necessary to have the journal bearings 48 and 50 at different levels to accommodate different heights when different wheels are involved. Again, this means that the mounting members 32 and 34 must be effectively placed at particular locations on the ends of the side frame 14.

FIG. 3 illustrates the connection of the member 34 within the gusset 37 and 38, which in turn is secured to the end of the side frame 14. A type of primary suspension system 42 adapted to fit into the mounting member 34 is illustrated. Also, the journal bearing 50 which fits into the primary bearing 42 is illustrated.

As illustrated in FIG. 3, the primary suspension spring 42 is adapted to fit into the mounting 34. Journal bearing includes the wheel axle assembly 46 adapted to fit into the primary suspension bearing 42. The assembly is held together by means of a plate 52 secured to the mounting member 34 by means of suitable assembly bolts 54 and 56.

Figure 5:
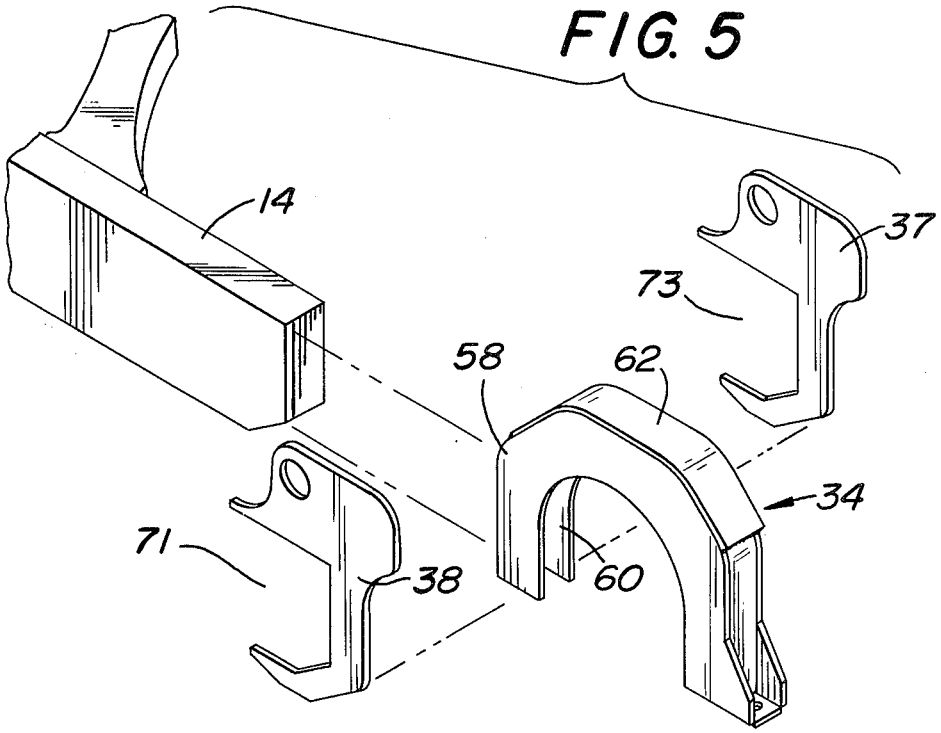
FIG. 5 is an exploded view illustrating the main parts of the present invention.

Referring to FIG. 5, an exploded view illustrates that the mounting 34 may be first welded at any desired location on the end of the side frame 14. After the mounting 34 is connected, the front gusset element 38 and a rear similarly designed gusset element 37 is positioned over the ends of the side frame 14. Cut away rectangular openings 71 and 73 are dimensioned to fit over the end of the side frame 14. With the gusset elements 37 and 39 in place, they are then welded to the end of the side frame 14 and to the front and back plates 58 and 60 (FIG. 6) of the mounting member 34.

Referring to FIG. 6, the mounting member 34 is broken away to show side plates 58 and 60 which are welded together by means of a top plate 62. A support plate 61 is welded or secured between the plates 58 and 60 and below the top plate 62. The plate 61 receives the primary suspension and journal bearings therein. All the parts illustrated are welded together to provide the mounting 34.

Thus it is seen that the basic truck with standard mountings may be employed to facilitate mass production of parts. This in turn leads to greater reduction in cost for the parts involved. The only item which need be specially designed involves the gusset or connecting elements between the mounting members and the side frames.

What is claimed is:

1. A railway truck comprising:

(a) a main body including a pair of spaced longitudinally extending parallel side frames connected by transverse connecting members, the ends of said side frame extending beyond said connecting frame members and disposed to receive mounting members;

(b) a plurality of mounting members for receiving suspension elements and journal mountings for wheel-axle assemblies, (c) means for connecting said mounting members at predetermined locations on said truck side frames, (d) a plurality of gusset members connecting the ends of said side frames to the sides of said mounting members to provide a principal structural load path between said end frames and mountings; and (e) a pair of gussets are connected to each of said mounting member on opposite sides of each of said mounting member, said connections between said side frames, said gussets and said mounting members comprise weld connections for providing two separate structural paths between said side frames and said mounting members.

2. A railway truck as set forth in claim 1 wherein said mounting members are adapted to be connected to different heights on said side frame to accommodate different sizes of suspension elements and journal mountings for wheel-axle assemblies.

3. A railway truck as set forth in claim 2 wherein said suspension elements and said journal mountings are adapted to fit into said mounting members.

4. A railway truck as set forth in claim 3 wherein said gussets include cut-away areas disposed to fit over the ends of said side frames.

5. A railway truck as set forth in claim 4 wherein each of said mounting members include a pair of side plates welded together by a top plate and a support plate welded to said pair of side plates below said top plate for receiving said suspension elements and said journal mountings.

* * * * *